US005536142A

United States Patent [19]

Hsieh

[11] Patent Number: 5,536,142

[45] Date of Patent: Jul. 16, 1996

[54] OFF STATE DEMONSTRATING DEVICE FOR A CEILING FAN

[76] Inventor: Frank Hsieh, No. 103, Ta Feng Rd., Sheng Kang Hsiang, Taichung Hsien, Taiwan

[21] Appl. No.: 368,457

[22] Filed: Jan. 4, 1995

[51] Int. Cl.[6] ..... F04B 21/00

[52] U.S. Cl. ..... 416/61; 416/5; 340/644; 340/641

[58] Field of Search ..... 416/5, 61; 200/317, 200/312; 340/644, 628, 641, 648

[56] References Cited

U.S. PATENT DOCUMENTS

| | | | |
|---|---|---|---|
| 3,146,325 | 8/1964 | Gribble | 340/641 |
| 4,221,945 | 9/1980 | Mobus et al. | 200/317 |
| 4,494,055 | 1/1985 | Bitting et al. | 416/5 |
| 4,549,050 | 10/1985 | Lang | 200/312 |
| 4,675,663 | 6/1987 | Corwin | 416/61 |
| 4,762,463 | 8/1988 | Yang | 416/5 |
| 4,768,926 | 9/1988 | Gilbert, Jr. | 416/61 |
| 5,189,412 | 2/1993 | Mehta et al. | 340/825.22 |
| 5,288,957 | 2/1994 | Swaybill | 200/317 |

*Primary Examiner*—F. Daniel Lopez
*Assistant Examiner*—Mark Sgantzos
*Attorney, Agent, or Firm*—Pro-Techtor International

[57] ABSTRACT

An off state demonstrating device on a line-pulling switch for a ceiling fan, is characterized in that a display or demonstrating device is jumper connected at the off position of the switch, so that when the switch is in an off state, the display or demonstrating device can be turned on and a user can be advised that the ceiling fan is in an off state.

6 Claims, 3 Drawing Sheets

OFF STATE DEMONSTRATING DEVICE FOR A CEILING FAN

BACKGROUND OF THE INVENTION

1. Field of the Invention

The present invention relates to an off state displaying device advising a user that whether a line-pulling switch of a ceiling fan is in an off state.

2. Description of the Prior Art

A conventional chain or line-pulling switch on a ceiling fan uses a cyclic speed adjusting or changing over switch which has no illustration about the shift positions or the off state thereof, when one is going to turn off the ceiling fan, he should wait patiently till the inertial rotation of the ceiling fan completes so as to be sure that it is in an off state; If one can not wait or does not want to wait for the ceiling fan to completely stop, and if the pulling line of the switch of the ceiling fan has not been pulled to the off position rather than some low speed shift position wherein one can hardly distinct it from an off state, in this situation, when the user leaves, the ceiling fan can rotate continually, thus waste of electric energy will be created.

SUMMARY OF THE INVENTION

In view of this, the inventor of the present invention provides a thourough solution and improvement against the disadvantage of the conventional ceiling fan, and thus products the off state displaying device of the present invention which may advise a user that whether a line-pulling switch of a ceiling fan is in an off state.

The main object of the present invention is to let know of a user through a display or demonstrating device about the off state of a ceiling fan.

The present invention is characterized in that a display or demonstrating device is jumper connected at the off position of a conventional chain- or line-pulling switch on a ceiling fan, so that when the switch is in an off state, the display or demonstrating device can be turned on and a user can be advised that the ceiling fan is in an off state.

The present invention will be apparent in its object, technical measure, and functions after reading the detailed description of the preferred embodiment thereof in reference to the accompanying drawings.

DETAILED DESCRIPTION OF THE PREFERRED EMBODIMENT

In the present invention, at the off position of the line- or chain-pulling switch of a ceiling fan, there is a display or demonstrating device for turning on of it when the switch is in an off position and to advise a user that the ceiling fan is in an off state.

Figure 1:
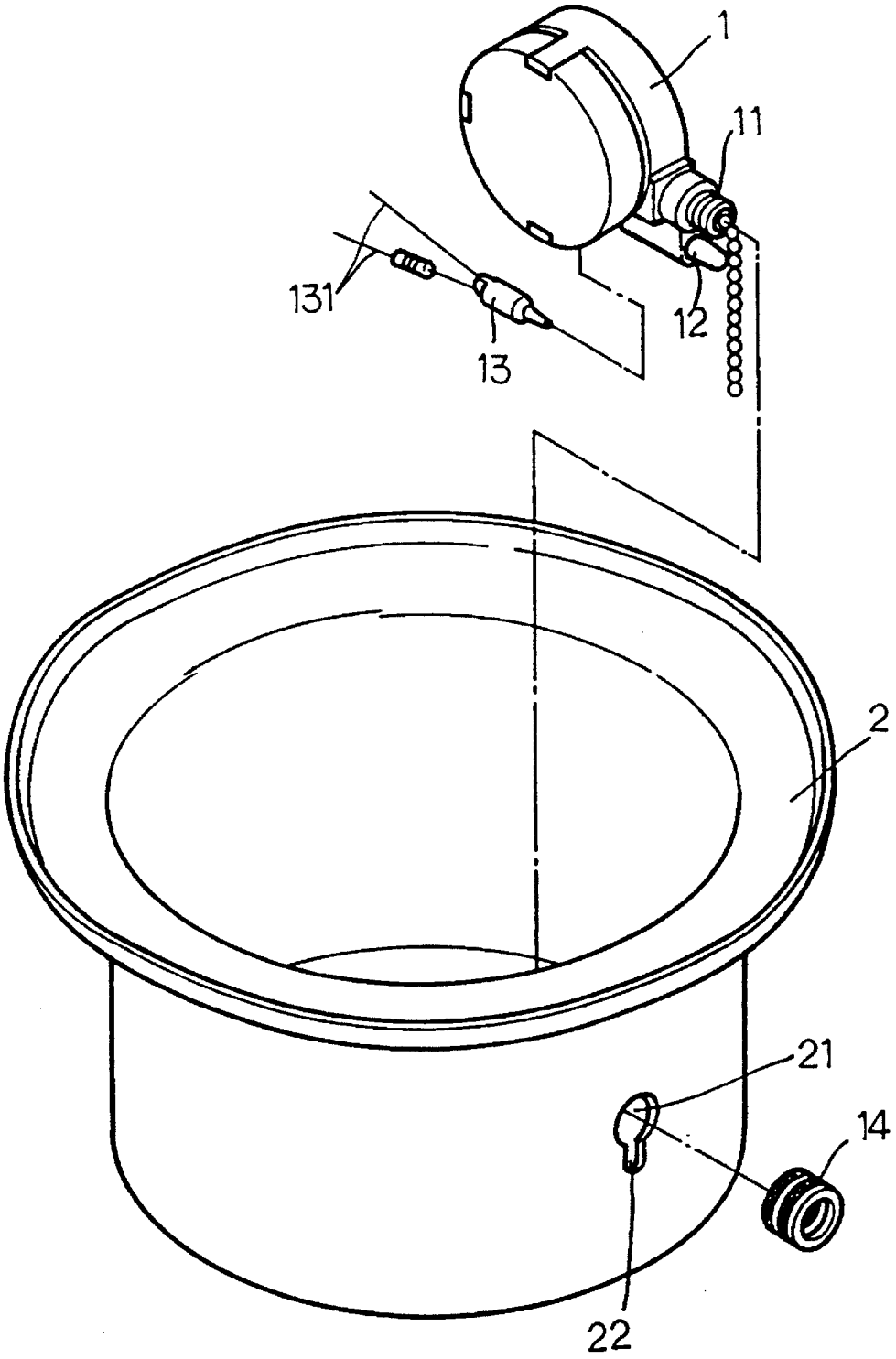
FIG. 1 is a schematic perspective view of the present invention wherein a bulb is used as a part of the demonstrating device.
Figure 2:
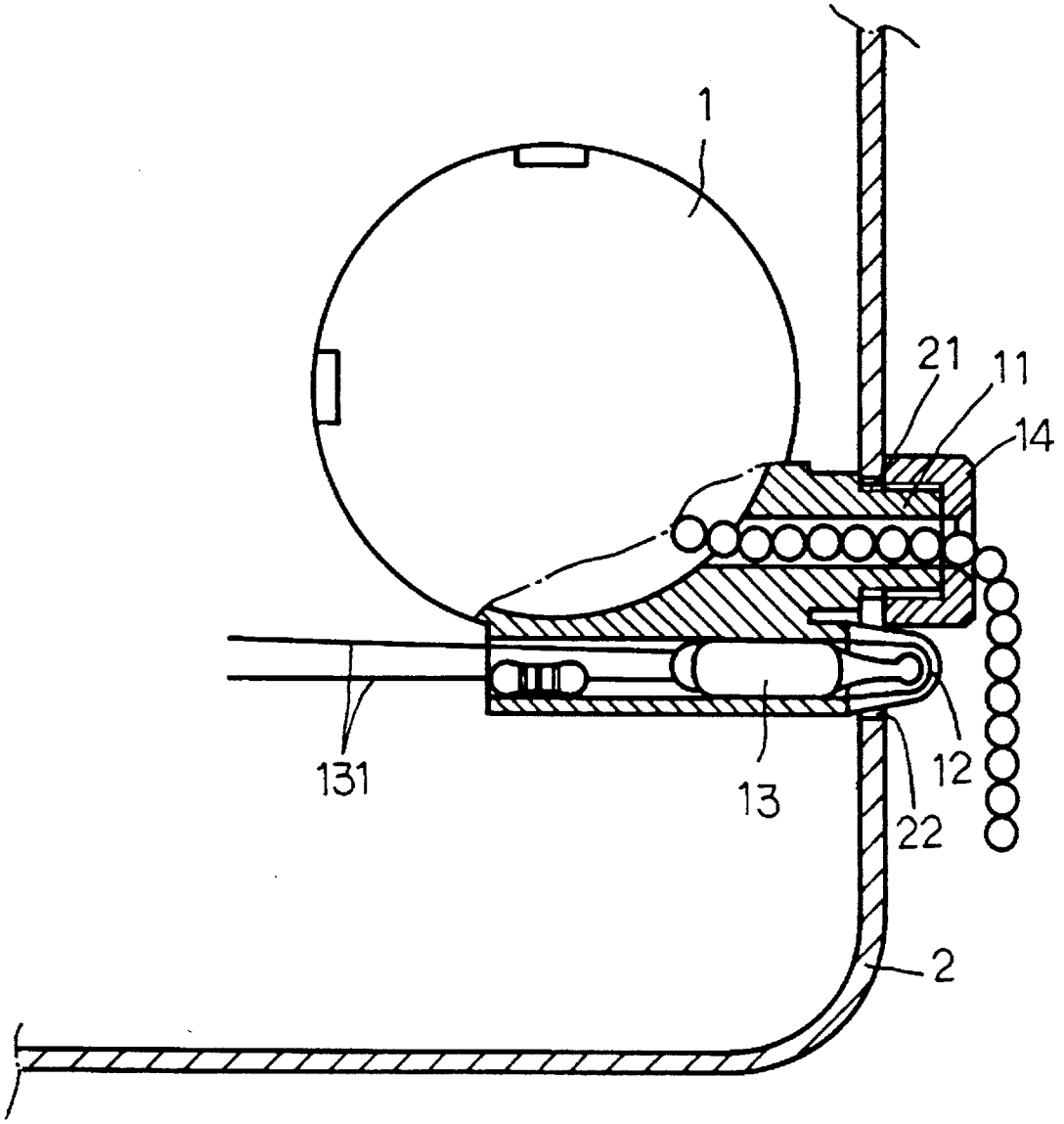
FIG. 2 is a schematic side sectional view of the embodiment as shown in FIG. 1.
Figure 3:
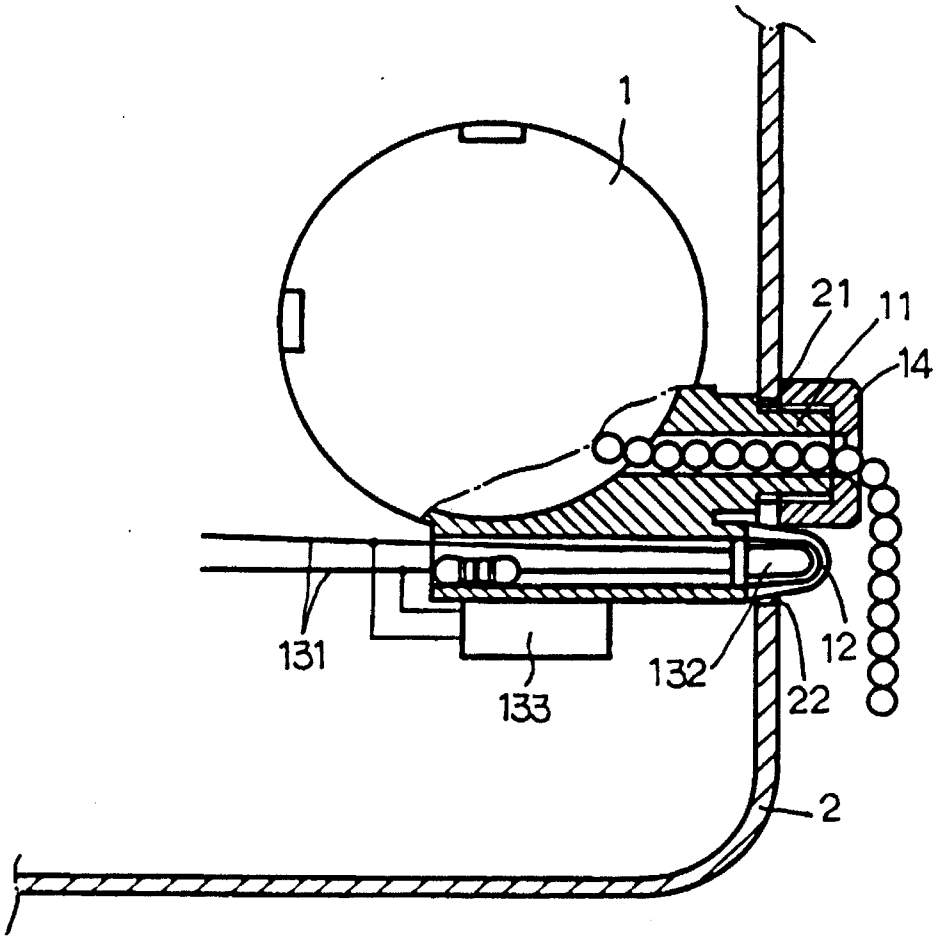
FIG. 3 is a side sectional view of an alternate embodiment.

As shown in FIG. 1 and 2, a display is used as a demonstrating device, a bulb seat 12 is provided suitably under the control end 11 of a line-pulling switch 1, a bulb 13 (or an LED 132) is provided in the bulb seat 12, wherein two electric power lines 131 are jumper connected at the off position of the switch 1 via one end of the bulb 13, and an elongate hole 22 is provided beneath a round hole 21 on a housing 2 for mounting of the line-pulling switch 1, when in assemblying, the bulb seat 12 is limited by the elongate hole 22 and therefore prevents the line-pulling switch 1 from rotating with an external nut 14 when the nut 14 is driven for fixing, and further allows the bulb 13 to be exposed out from the housing 2 to give demonstration; the bulb seat 12 can, beside being provided under the control end 11 of the line-pulling switch 1, be provided at some other suitable position protruding from the housing 2 to have the same effect as well.

The demonstrating device used in the present invention can be a display having light illuminating effect, such as a bulb, an LED etc., and can also be a warning device 133 having an acoustic sound emitting effect, such as a sound generator or a buzzer.

If a sound demonstrating device is used in the present invention, this sound demonstrating device can be provided inside the housing 2 at any suitable location.

My invention may assume numerous forms and is to be construed as including all modifications and variations falling within the scope of the appended claims.

I claim:

1. An off state demonstrating device on a line-pulling switch for a ceiling fan comprising;

a display device connected to an off position of said switch such that when said switch is in an off position, said display device is activated, and wherein a bulb seat is provided under a control end of said line-pulling switch, an elongated hole is provided beneath a round hole on a housing for mounting said line-pulling switch, and an external nut is affixed to said line-pulling switch to prevent rotation of said switch, and wherein said bulb seat protrudes from said elongated hole so that it may be observed by a viewer.

2. The off state demonstrating device of claim 1 wherein: said display device is a bulb.

3. The off state demonstrating device of claim 1 wherein: said display device is an LED.

4. An off state demonstrating device on a line-pulling switch for a ceiling fan comprising;

an acoustic warning device connected to an off position of said switch such that when said switch is in an off position, said acoustic warning device is activated, and wherein a round hole is provided on a housing for mounting said line-pulling switch, and an external nut is affixed to said line-pulling switch to prevent rotation of said switch.

5. The off state demonstrating device of claim 4 wherein: said acoustic warning device is a sound generator.

6. The off state demonstrating device of claim 4 wherein: said acoustic warning device is a buzzer.

* * * * *